US006382941B1

(12) United States Patent
VanBritson et al.

(10) Patent No.: US 6,382,941 B1
(45) Date of Patent: May 7, 2002

(54) DEVICE AND METHOD TO PREVENT MISBUILD AND IMPROPER FUNCTION OF AIR CONDITIONING SCROLL COMPRESSOR DUE TO MISPLACED OR EXTRA STEEL SPHERICAL BALLS

(75) Inventors: Timothy R. VanBritson, Livonia; Dean J. Rim, Bloomfield Hills, both of MI (US); Joaquim S. Santos, Setubal (PT)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/749,207

(22) Filed: Dec. 27, 2000

(51) Int. Cl.[7] ..... F01C 1/02
(52) U.S. Cl. ..... 418/55.1; 418/151; 29/888.022
(58) Field of Search ..... 418/151, 55.1; 29/888.022

(56) References Cited

U.S. PATENT DOCUMENTS 4,439,118 A 3/1984 Iimori
4,552,517 A * 11/1985 Shimizu ..... 29/888.022
4,575,319 A * 3/1986 Terauchi ..... 29/888.022
4,608,001 A * 8/1986 Sugimoto et al. ..... 29/888.022
4,934,909 A * 6/1990 Suzuki et al. ..... 418/55.3
4,940,396 A 7/1990 Shimizu et al.
5,366,357 A * 11/1994 Fukanuma et al. ..... 418/55.5
5,513,968 A 5/1996 Ochiai
5,938,418 A 8/1999 Iizuka

FOREIGN PATENT DOCUMENTS

JP 05-302578 * 11/1993 ..... 418/55.5

* cited by examiner

*Primary Examiner*—Thomas Denion
*Assistant Examiner*—Theresa Trieu
(74) *Attorney, Agent, or Firm*—Larry I. Shelton

(57) ABSTRACT

In prior art scroll-type compressors, a cavity is formed in the interior of the compressor of a sufficient size to allow a misplaced or extra steel spherical ball to become lodged therein and cause seizure of the compressor. The present invention modifies a plate of the counterweight assembly or adds an additional component plate on the drive shaft of the compressor to prevent the introduction of an extra or misplaced steel spherical ball into this cavity during compressor assembly or repair.

5 Claims, 6 Drawing Sheets

DEVICE AND METHOD TO PREVENT MISBUILD AND IMPROPER FUNCTION OF AIR CONDITIONING SCROLL COMPRESSOR DUE TO MISPLACED OR EXTRA STEEL SPHERICAL BALLS

FIELD OF THE INVENTION

The present invention relates generally to the field of scroll-type compressors, and in particular to a device and method to prevent assembly error and improper functioning of a scroll-type compressor.

BACKGROUND OF THE INVENTION

Scroll-type compressors are well known in the prior art. They are used for compressing fluids of various types, for example, air conditioning refrigerant. U.S. Pat. Nos. 4,940,396 and 5,513,968 disclose scroll-type compressors that function by the interaction of two scroll members each having a circular end plate and a spiroidal or involute spiral element. The end plates of the scroll members face each other in parallel planes. One scroll member is connected to a drive shaft, rotated for example by an automotive engine, while the other scroll member is stationary, affixed in the compressor housing. The drive shaft is supported by bearings of typical design and is fitted with a counterweight assembly for the purpose of balancing the scroll member connected to the drive shaft during compressor activation. The scroll members maintain an angular and radial offset so that both spiral elements fit together at a plurality of line contacts between their curved surfaces and thereby seal off and define at least one pair of fluid pockets or chambers. The scroll member connected to the drive shaft is fixedly mounted by an eccentric bushing. In this manner, when the drive shaft rotates, the centerline axis of the moving scroll member is translated about the centerline axis of the stationary scroll member in an orbiting manner and is thus referred to as the orbiting scroll member. As the orbiting scroll member orbits around the stationary scroll member, the previously mentioned fluid chambers form between the spiral elements of the orbiting and stationary scroll members. Fluid is introduced into these chambers via intake ports in the compressor housing, is compressed when the volume in the chambers decreases as the orbiting scroll moves, and is expelled via discharge ports in the compressor housing.

The planar orbit of the orbiting scroll member is generated and controlled by numerous components with technology that has been available for some time. These same components prevent the orbiting scroll member from rotating. U.S. Pat. Nos. 4,439,118 and 5,938,418 disclose such components, known as ball coupling mechanisms or Oldham rings. The components of interest for the present invention are a plurality of steel spherical balls, an orbiting ball coupling ring, a fixed ball coupling ring, and a counterweight assembly. Each of the steel spherical balls is positioned in an associated one of a plurality of circular pockets formed in the fixed and orbiting ball coupling rings. During compressor assembly, the ball coupling mechanism is assembled by inserting the steel spherical balls into the pockets of the fixed ring, attaching the orbiting scroll member to the orbiting ring, aligning the circular pockets of the orbiting and fixed rings, and stacking the orbiting scroll and ring assembly to the fixed ring. The same process is followed when the compressor is repaired and reassembled. It is during this assembly or repair process that an extra or misplaced steel spherical ball may be intentionally or inadvertently placed in a counterweight cavity that is bounded by the front housing, the main drive bearing, the orbiting scroll member, the counterweight assembly, and the fixed ball coupling ring of the compressor. The prior art construction results in a path for the steel spherical balls to enter the aforementioned cavity. An extra or misplaced ball in this area will result in a catastrophic failure of the scroll compressor due to seizure of the compressor during operation. Restriction or prevention of the introduction of the steel spherical balls into the counterweight cavity, therefore, is imperative.

SUMMARY OF THE INVENTION

The present invention concerns a device and a method for preventing a steel spherical ball from entering a counterweight cavity of a scroll compressor during compressor assembly or repair thereby avoiding compressor seizure during operation. The prior art compressor construction allows a misplaced and/or extra steel ball to enter the counterweight cavity through a clearance path between the eccentric bushing and the fixed ball coupling ring. The device according to the present invention solves this problem either by modifying a component of the counterweight assembly or by adding a component to the drive shaft.

A first embodiment of the present invention involves a modification of the counterweight assembly to occupy a portion of the counterweight cavity opposite the existing counterweight assembly. A plate component of the counterweight assembly is changed to restrict the clearance path sufficiently to prevent any extra and/or misplaced balls from gaining access to this cavity. This modification also prevents assembly of the counterweight assembly, the fixed ball coupling ring, and/or the orbiting scroll member if a misplaced or extra steel ball is present in the counterweight cavity.

A second embodiment of the present invention involves the addition of a component plate on the shaft to limit the available space for a misplaced/extra steel ball. This additional component is mounted directly on the shaft and occupies space opposite the counterweight assembly, in a manner similar to the modified counterweight assembly of the first embodiment. The additional component also prevents the assembly of the counterweight assembly, the fixed ball coupling ring, and/or the orbiting scroll member if a misplaced or extra steel ball is present in the counterweight cavity.

In each embodiment, the present invention provides these improvements while not degrading the performance or reliability of the scroll compressor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
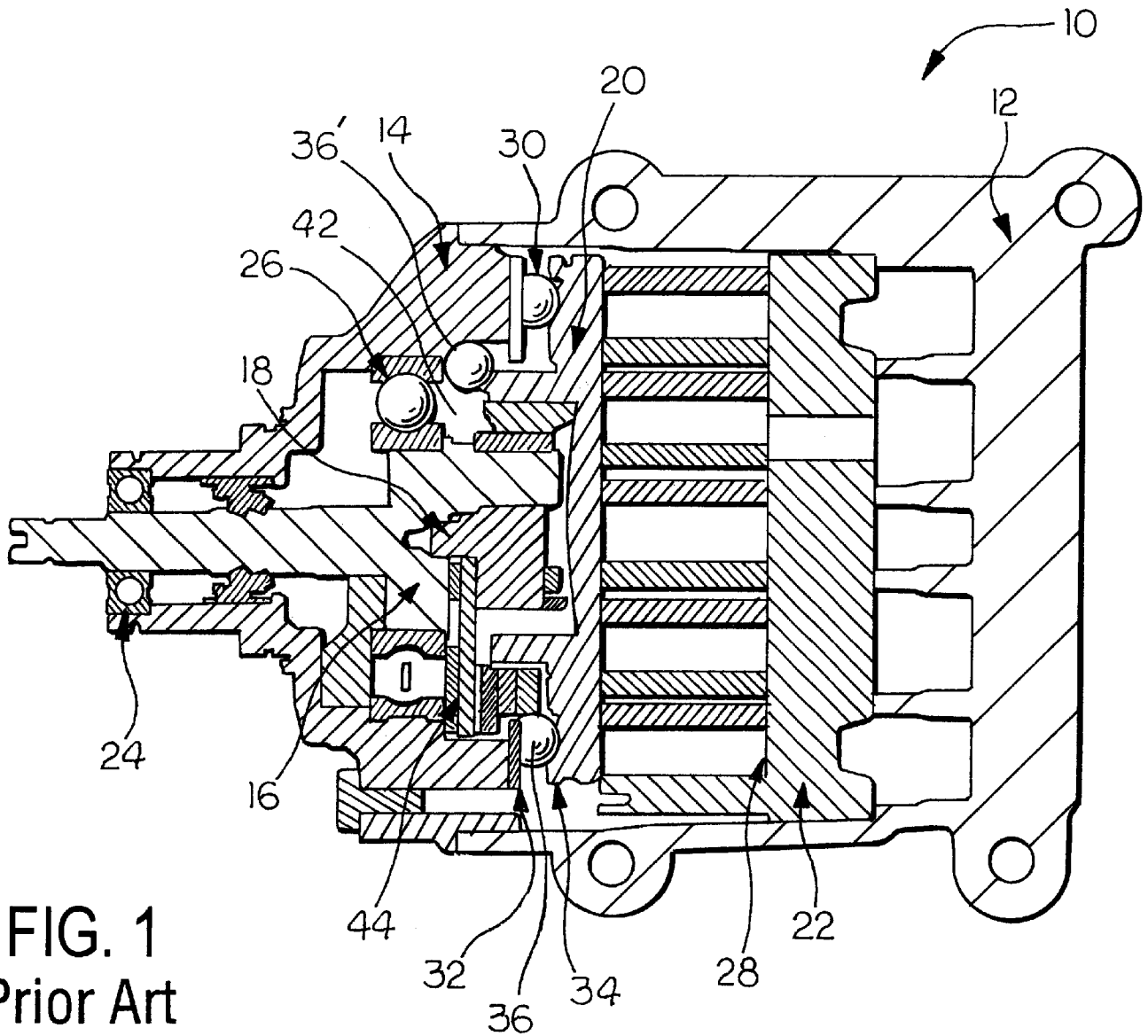
FIG. 1 Prior Art
FIG. 1 is a cross-sectional elevation view of a prior art scroll-type compressor with an extra or misplaced steel spherical ball in the counterweight cavity.

Referring to FIG. 1, a scroll-type compressor of prior art construction is indicated generally at 10 and includes a rear or main housing 12 attached to a front housing or cover 14 to form a hollow housing for the compressor working components. A crankshaft or drive shaft 16 extends through the front cover 14 and is rotatably supported on support bearings 24 and main drive bearings 26 mounted on the interior of the front cover. An eccentric bushing assembly 18 is attached to the drive shaft 16 and supports an orbiting scroll member 20. The orbiting scroll member 20 cooperates with a fixed scroll member 22 attached to the main housing 12 to define fluid chambers 28. As the drive shaft 16 is rotated, the centerline axis of the orbiting scroll member 20 orbits about the axis of rotation of the drive shaft 16 to alternately decrease and increase the volume of the fluid chambers 28. Fluid is introduced into the increased volume chambers 28 via intake ports (not shown) and, as the orbiting scroll member 20 moves, the fluid chambers 28 decrease in volume to compress the fluid which is expelled from the fluid chambers 28 and out of the compressor 10 via discharge ports (not shown).

Figure 2:
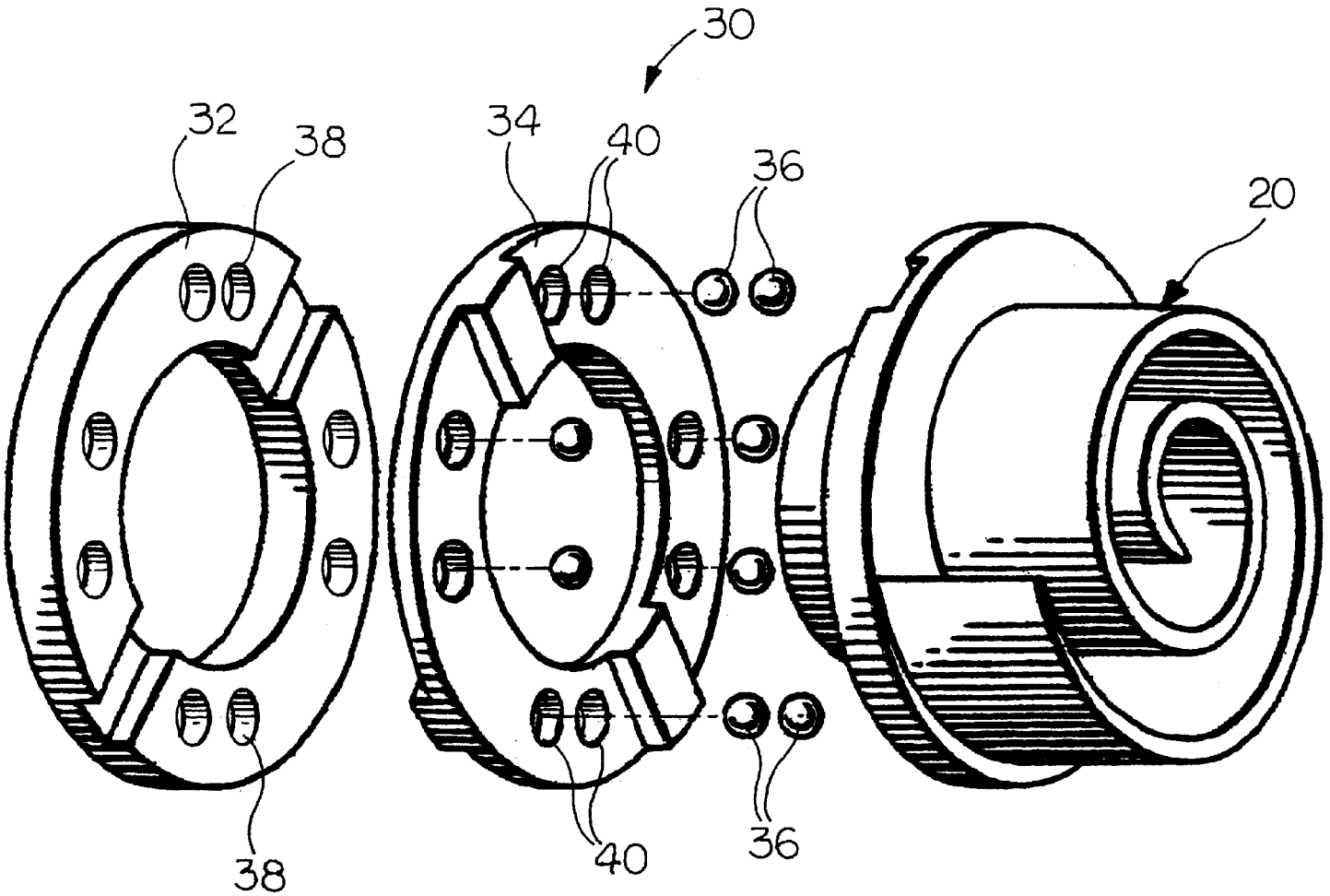
FIG. 2 Prior Art
FIG. 2 is an exploded view of the ball coupling mechanism and orbiting scroll member of FIG. 1.

It is critical to the operation of the compressor that the radial offset relationship between the orbiting scroll member 20 and the stationary scroll member 22 is maintained. This offset relationship is accomplished by preventing the rotation of the orbiting scroll member. The orbiting scroll member is prevented from rotating by the use of a ball coupling mechanism 30, shown in greater detail in FIG. 2. The ball coupling mechanism 30 includes a fixed ball coupling ring 32 attached to the front cover 14, an orbiting ball coupling ring 34 coupled to the orbiting scroll member 20, and a plurality of steel spherical balls 36. The ball coupling mechanism 30 is assembled with the front cover 14 detached from the main housing 12 and oriented with the drive shaft 16 pointed downwardly. The steel spherical balls 36 are inserted into associated pockets 38 formed in the fixed ring 32. The orbiting scroll member 20 is coupled to the orbiting ring 34 and mounted on the eccentric bushing assembly 18 while aligning pockets 40 formed in the orbiting ring with the pockets 38 of the fixed ring 32. The ball coupling mechanism 30 is assembled in this manner during initial manufacture and repair of the scroll-type compressor 10.

As shown in FIG. 1, a counterweight cavity 42 is formed inside the front cover 14 on the opposite side of the drive shaft 16 from a counterweight assembly 44 attached to the drive shaft. This counterweight cavity 42 is bounded by the front cover 14, the main drive bearing 26, the drive shaft 16, the counterweight assembly 44, the orbiting scroll member 20, and the ball coupling mechanism 30. The counterweight cavity 42 is large enough so that an extra or misplaced steel spherical ball 36' could be introduced into the cavity during compressor assembly or repair without preventing the compressor 10 from being assembled or reassembled. If the extra or misplaced ball 36' is situated in the cavity 42 and not removed prior to assembly, the result is a catastrophic failure upon startup of the compressor 10 due to seizure since the extra ball 36' will prevent proper rotation of the shaft 16 by contact with the counterweight assembly 44.

Figure 4:
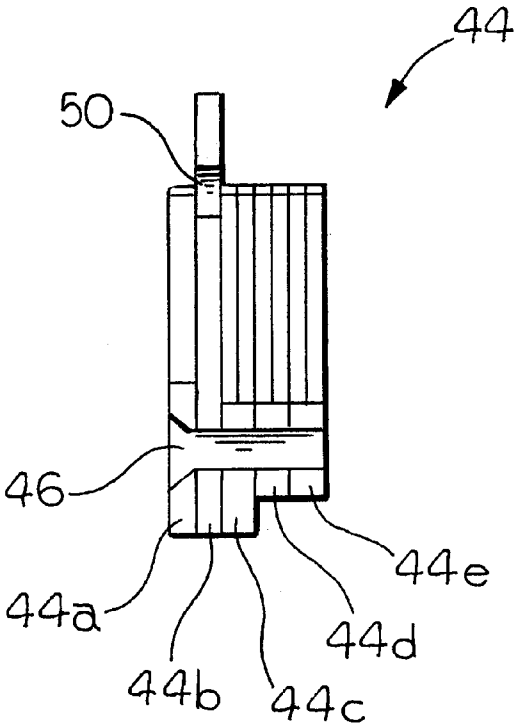
FIG. 4 Prior Art
FIG. 4 is a cross-sectional view taken along the line 4—4 in FIG. 1.
Figure 3:
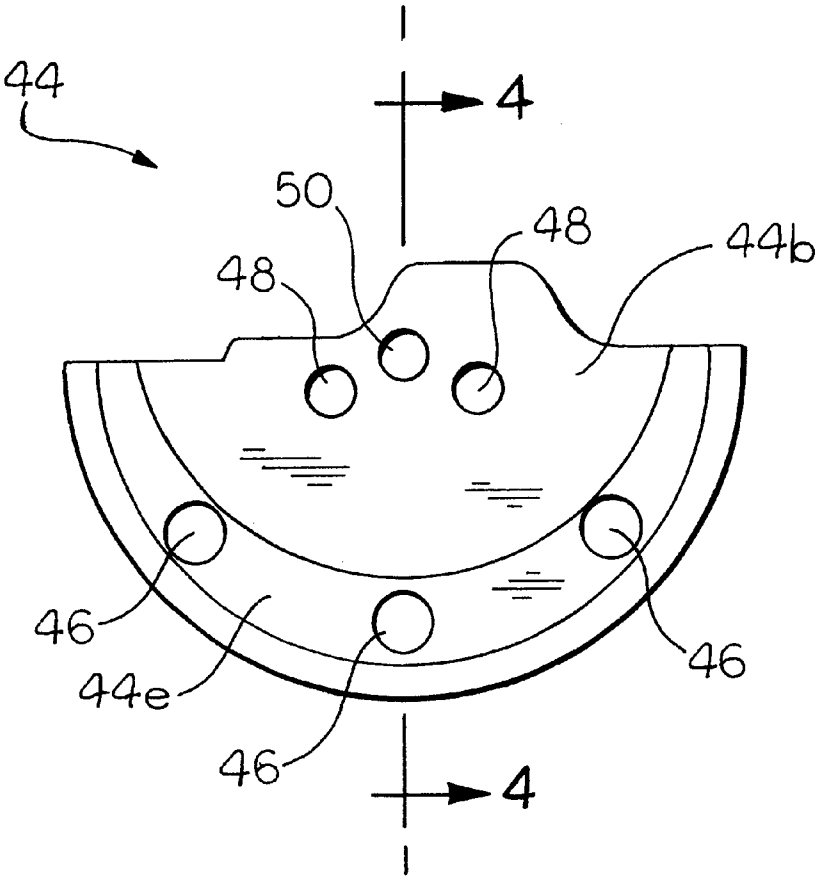
FIG. 3 Prior Art
FIG. 3 is front elevation view of the counterweight assembly of FIG. 1.

The device and method according to the present invention, in two preferred embodiments outlined below, prevents the introduction of extra or misplaced steel spherical balls 36' into the counterweight cavity 42 during compressor assembly or repair, which in turn prevents compressor seizure. A first preferred embodiment of the present invention includes a modified counterweight assembly. A prior art counterweight assembly 44 is shown in more detail in FIG. 3 and FIG. 4. The counterweight assembly 44 includes five plates 44*a*, 44*b*, 44*c*, 44*d*, and 44*e* held together in stacked orientation by a plurality of fasteners such as rivets 46. The plates 44*a* and 44*c* through 44*e* are generally arcuate while the plate 44*b* is formed as slightly more than a half circle. The plate 44*b* has a pair of apertures 48 formed therein for attachment to the drive shaft 16 by fasteners (not shown). A central aperture 50 is formed in the plate 44*b* for receiving a compliance pin (not shown) of the eccentric bushing 18.

Figure 6:
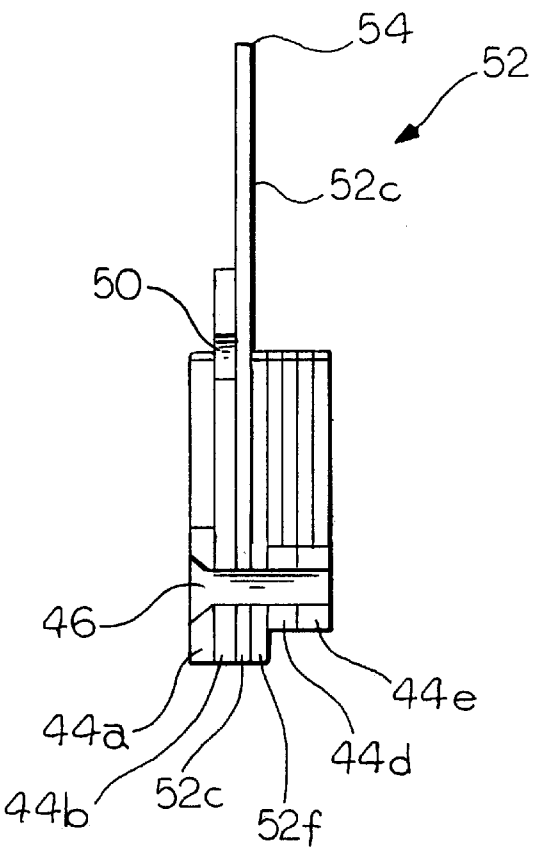
FIG. 6 is a cross-sectional view taken along the line 6—6 in FIG. 5.
Figure 5:
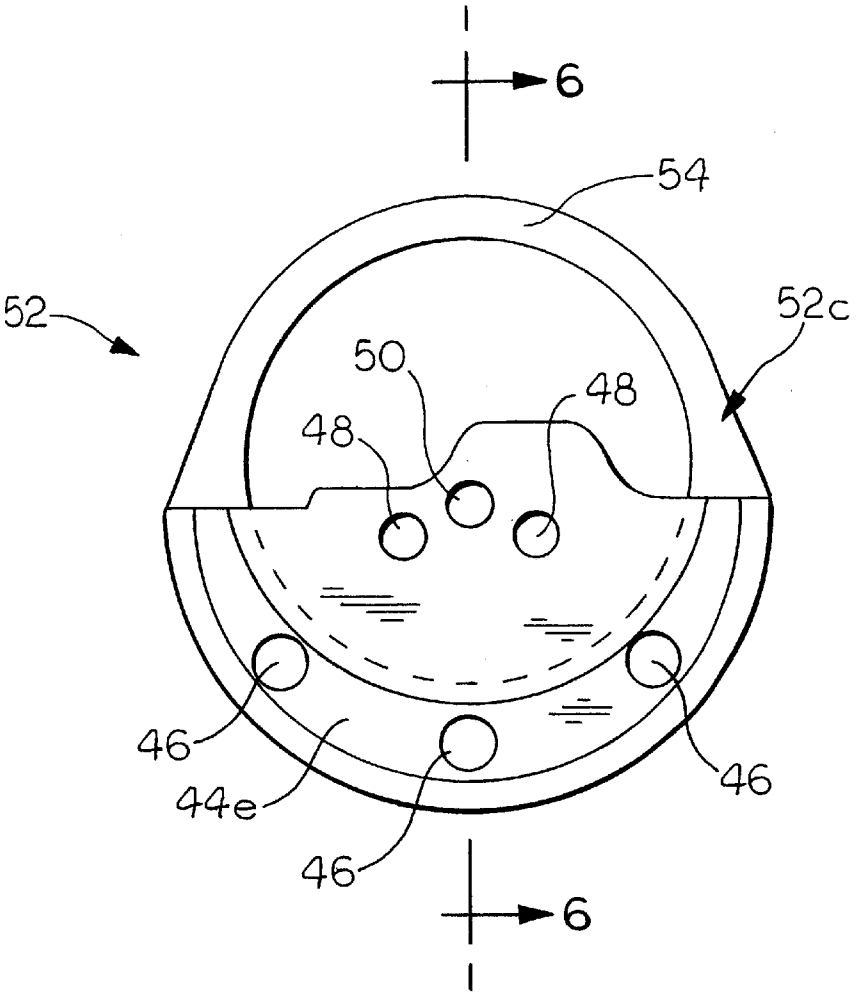
FIG. 5 is front elevation view of a counterweight assembly according to the present invention.

A first preferred embodiment of the present invention includes a modified counterweight assembly 52 shown in FIG. 5 and FIG. 6. The assembly 52 includes the plates 44*a*, 44*b*, 44*d* and 44*e* from the prior art assembly 44. However, the plate 44*c* has been replaced by two plates 52*c* and 52*f*. The plate 52*c* is similar in shape to the plate 44*c*, but is thinner. The plate 52*f* has a thickness corresponding to the difference in thickness between the plates 44*c* and 52*c* and a suitable mass such that overall thickness and weight of the counterweight assembly 52 remains unchanged from the counterweight assembly 44. However, the plate 52*c* has an annular shape including an arcuate portion 54 that extends into the counterweight cavity 42 when the compressor is assembled.

Figure 7:
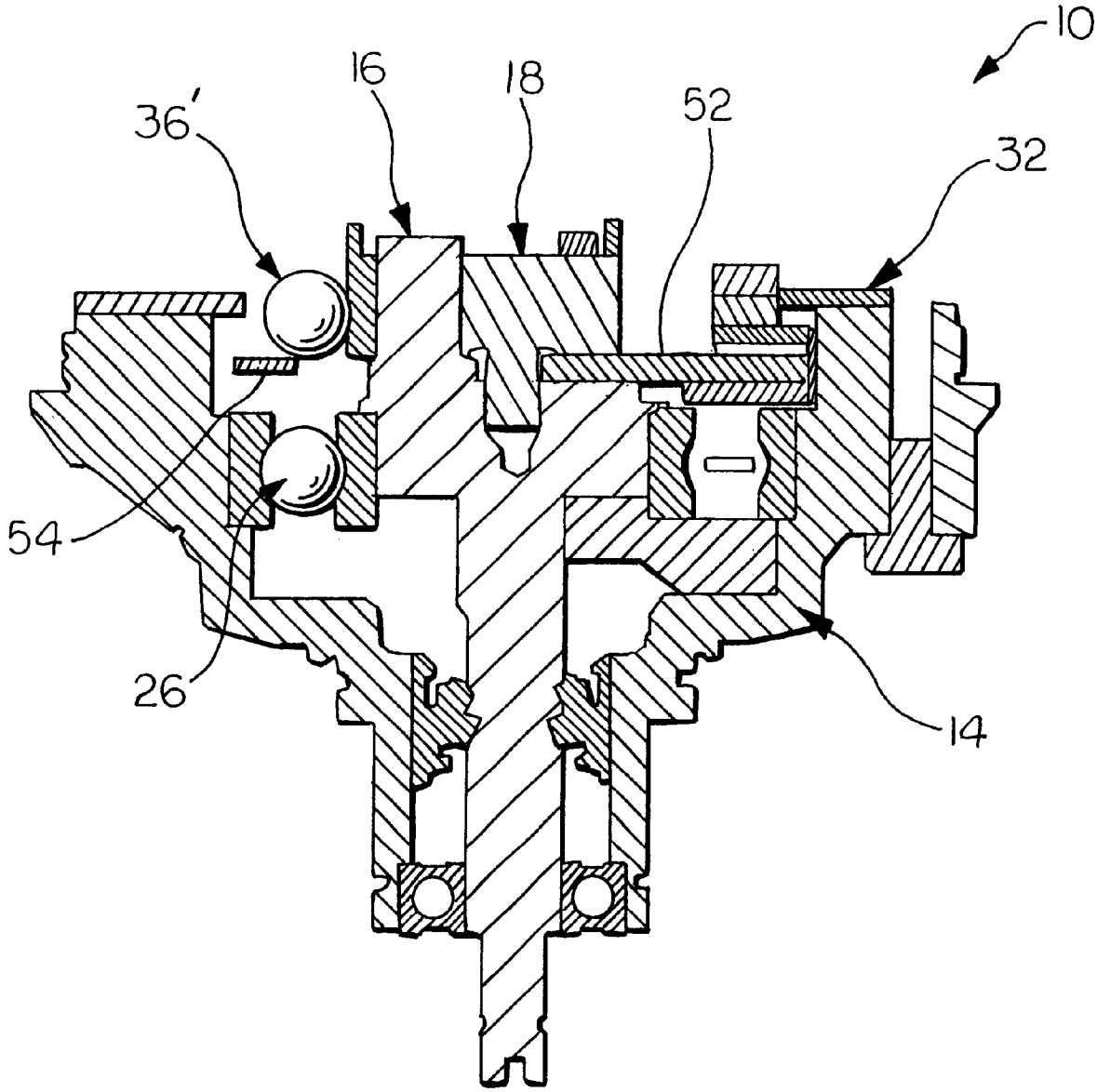
FIG. 7 is a fragmentary cross-sectional elevation view of the compressor shown in FIG. 1 including the counterweight assembly of FIG. 5.

As shown in FIG. 7, the modified counterweight assembly 52 will not allow the assembly of the orbiting scroll member 20 with misplaced or extra steel spherical ball 36'. When the extra ball 36' is misplaced into the counterweight cavity 42, the ball is supported by the arcuate portion 54 at an elevated level making it impossible for the orbiting scroll 20 (not shown) to be placed on top of the eccentric bushing 18. In addition, the elevated ball 36' will be more visible to the operator during the assembly or repair process, reducing the possibility that the operator will attempt to assemble the compressor 10 with an extra ball in place.

Figure 8:
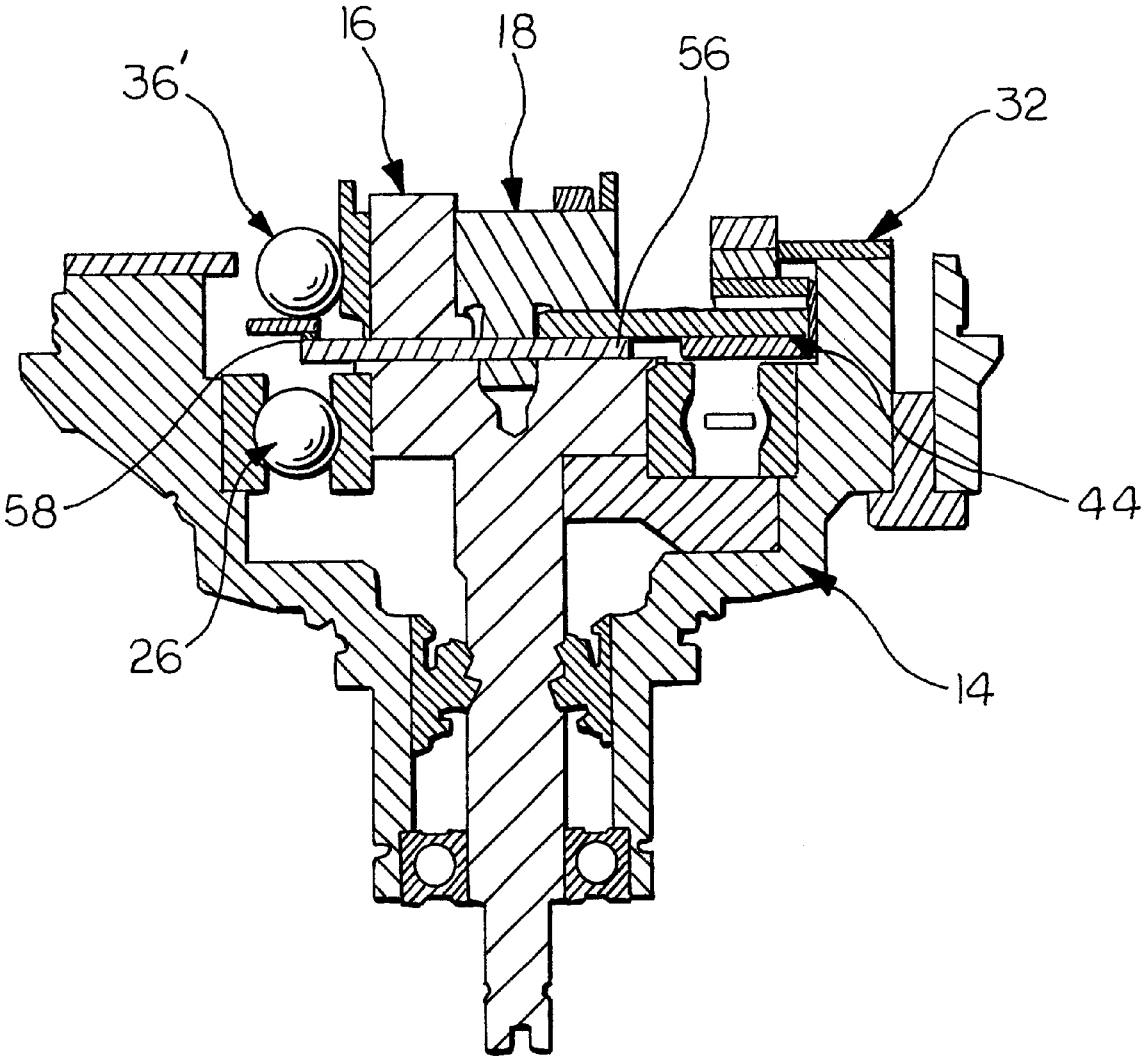
FIG. 8 is a fragmentary cross-sectional elevation view of the compressor shown in FIG. 1 including an alternate embodiment of the counterweight assembly according to the present invention.

A second preferred embodiment of the present invention is shown in FIG. 8. An additional component in the form of a thin plate 56 is mounted between an end of the drive shaft 16 and the bushing 18. The prior art counterweight assembly 44 remains unchanged. A portion 58 of the plate 56 extends into the counterweight cavity 42. When the ball 36' is misplaced in the counterweight cavity 42, the ball is supported by the portion 58 at an elevated level making it impossible for the orbiting scroll 20 (not shown) to be placed on top of the eccentric bushing 18.

In both of the embodiments described above, a plate portion is positioned in the counterweight cavity 42 to elevate the misplaced ball 36' making it impossible to continue assembly of the compressor.

In accordance with the provisions of the patent statues, the present invention has been described in what is considered to be its preferred embodiments. However, it should be noted that this invention may be practiced otherwise than as specifically illustrated and described without departing from its spirit or scope.

What is claimed is:

1. A scroll-type compressor comprising:

a housing forming a counterweight cavity;

a drive shaft extending into and rotatably supported by said housing;

an orbiting scroll member positioned in said housing and coupled to said drive shaft by an eccentric bushing;

a fixed scroll member mounted in said housing adjacent said orbiting scroll member;

a ball coupling mechanism connected between said orbiting scroll member and said housing, said ball coupling mechanism having a fixed ball coupling ring, an orbiting coupling ring, and a plurality of balls trapped between said rings;

a counterweight assembly mounted on said drive shaft; and a plurality of plates connected to one of said drive shaft and said counterweight assembly, a portion of at least one of said plates extending into said counterweight cavity, whereby during assembly of the compressor, a misplaced ball is supported by said portion of at least one of said plates to prevent proper assembly of said orbiting scroll member in said housing.

2. The compressor according to claim 1 wherein said plurality of plates are connected between said drive shaft and eccentric bushing.

3. The compressor according to claim 1 wherein said portion of the at least one of said plates is arcuate.

4. A method of assembling a scroll-type compressor comprising the steps of:

a. providing a front housing forming a counterweight cavity;

b. mounting a drive shaft extending into and rotatably supported by said housing; and c. locating a plurality of plates in the front housing connected to one of the drive shaft and a counterweight assembly, a portion of at least one of the plates extending into the counterweight cavity to support a misplaced ball to prevent assembly of an orbiting scroll member in the housing.

5. The method according to claim 4 wherein step c. includes connecting the plurality of plates between the drive shaft and an eccentric bushing for supporting the orbiting scroll member.

* * * * *